US005829587A

United States Patent [19]

Saiki et al.

[11] Patent Number: 5,829,587

[45] Date of Patent: Nov. 3, 1998

[54] PACKAGE BOX FOR A SPARK PLUG

[75] Inventors: Yoshiaki Saiki; Mitsutaka Yoshida, both of Nagoya, Japan

[73] Assignee: NGK Spark Plug Co., Ltd., Nagoya, Japan

[21] Appl. No.: 907,865

[22] Filed: Aug. 11, 1997

Related U.S. Application Data

[63] Continuation-in-part of Ser. No. 623,302, Mar. 28, 1996, abandoned.

[30] Foreign Application Priority Data

Mar. 31, 1995 [JP] Japan ..... 8-75357

[51] Int. Cl.[6] ..... B65D 85/00

[52] U.S. Cl. ..... 206/327; 206/485

[58] Field of Search ..... 206/327, 211, 206/485, 443, 490, 461, 471

[56] References Cited

U.S. PATENT DOCUMENTS

| | | | |
|---|---|---|---|
| 2,339,555 | 1/1944 | Glass . | |
| 2,442,980 | 6/1948 | Lewis, Jr. . | |
| 3,276,574 | 10/1966 | Meyers . | |
| 4,058,207 | 11/1977 | Koltz . | |
| 4,896,766 | 1/1990 | Paley . | |
| 5,261,535 | 11/1993 | Light et al. | 206/485 |
| 5,358,116 | 10/1994 | Brintazzoli | 206/485 |
| 5,494,166 | 2/1996 | Kuwata et al. . | |
| 5,577,606 | 11/1996 | Schwentuchowski et al. . | |

FOREIGN PATENT DOCUMENTS

| | | | |
|---|---|---|---|
| 2658787 | 8/1991 | France | 206/485 |
| 7507988 | 9/1995 | Japan . | |

*Primary Examiner*—Paul T. Sewell
*Assistant Examiner*—Luan K. Bui
*Attorney, Agent, or Firm*—Sughrue, Mion, Zinn, Macpeak & Seas, PLLC

[57] ABSTRACT

In a package box for a plurality of spark plugs, a paper tray has an array of lower cellular boxes provided to accommodate lower portions of spark plugs to protect their spark gaps against dimensional alteration, and an array of upper cellular boxes provided to retain upper portions of the spark plugs in place. A casing package is provided to accommodate the paper tray. The lower cellular boxes have circular crease lines each about the size so that Individual thread portions of the spark plugs are to be inserted, and having a plurality of incision lines provided to be oriented radially toward central portions of the circular crease lines. Accommodation holes are formed with pluralistic tabs by expanding the incision lines and bending along the circular crease lines so as to accommodate the thread portions of metallic shells of the spark plugs with the thread portions supportably engaged by the tabs when forcing outer electrodes and the thread portions of the spark plugs against sections surrounded by the circular crease lines. The upper cellular boxes have upper open ended U-shaped retainer holes to admit the head portions of insulators of the spark plugs so that the tray accommodates the spark plugs with the insulators exposed between the array of the upper and lower cellular boxes.

8 Claims, 12 Drawing Sheets

PACKAGE BOX FOR A SPARK PLUG

This is a Continuation-in-Part of application Ser. No. 08/623,302 filed Mar. 28, 1996 abandoned.

BACKGROUND OF THE INVENTION

1. Field of the Invention

This invention relates to a package box in which a plurality of spark plugs are accommodated.

2. Description of the Prior Art

By way of illustration (FIG. 12), upon packing or crating a plurality of spark plugs to prepare a delivery, a spacer ring (protector cap) 110 has been used to cover an outer electrode 104 of each spark plug 100 so as to protect a spark gap against dimensional alteration. Then, the spark plugs are individually encased in corresponding caskets 200 which are packed all together by a carton 300.

Otherwise, a plurality of spark plugs are placed on a plastic tray which is preformed to correspond to each appearance of the spark plugs. Then, the spark plugs and the plastic tray are packed all together by a package case.

However, in the former package in which the spark plugs are packed twice by the casket 200 and the carton 300, it takes time in packing or crating the spark plug. Upon opening the package to take out the spark plug, it is troublesome because each of the individual caskets 200 must be repeatedly unpacked after opening the carton 300.

In the latter package in which the plastic tray is used, once the plastic tray is withdrawn from the package case, to take out the specified ones, the rest of the spark plugs are likely to be isolated. It is troublesome to manage the spark plugs thus isolated.

Therefore, it is one of the objects of the invention to provide a package box with sufficient strength which is capable of readily packing or crating a plurality of spark plugs while protecting their spark gap against dimensional alteration and easily taking out the spark plug upon unpacking while easily managing the spark plugs left in the package box.

SUMMARY OF THE INVENTION

According to the present invention, there is provided a package box for a spark plug comprising: a paper tray including an array of lower cellular boxes provided to accommodate lower portions of spark plugs to protect their spark gaps, and an array of upper cellular boxes provided to retain upper portions of said spark plugs in place; a casing package provided to accommodate said paper tray; said lower cellular boxes having circular crease lines each about the size so that individual thread portions of said spark plugs are to be inserted, and having a plurality of incision lines provided to orient radially toward central portions of said circular crease lines; accommodation holes being formed with pluralistic tabs by expanding said incision lines and bending along said circular crease lines so as to accommodate thread portions of metallic shells with said thread portions supportably engaged by said tabs when forcing outer electrodes and the thread portions of said spark plugs against regions surrounded by said circular crease lines; and said upper cellular boxes having upper open ended U-shaped retainer holes to admit head portions of insulators of said spark plugs so that said tray accommodates said spark plugs with said head portions of said insulators exposed between said array of the upper cellular boxes and said array of the lower cellular boxes.

According to another aspect of the invention, said circular crease lines of said accommodation holes are defined by circular perforations.

According to still another aspect of the invention, streaks of perforations are provided on the tray so as to be separable between the neighboring upper and lower cellular boxes.

According to a further aspect of the invention, said casing package is made of a transparent material directly encircling around the tray.

According to a further aspect of the invention, a mount board is provided which has a hanging hole formed on an underside of said casing package.

According to a further aspect of the invention, a mount board is provided which has a hanging hole formed on an underside of said tray.

According to a further aspect of the invention, stopper lugs are provided to protect the head portions of said insulators securely against the removal from said retainer holes of said array of the upper cellular boxes of said tray.

Due to the fact that a plurality of spark plugs already accommodated by the tray is further enclosed by the casing package upon packing or crating the spark plugs, it is possible to eliminate the necessity of encasing the individually packed spark plugs so as to substantially facilitate the packing operation since the pluralistic spark plugs are all together accommodated by the tray.

Upon using the spark plugs, the spark plugs are readily accessible in the tray only by opening the casing package. This makes it possible to readily take out any of the spark plugs with ease.

With the compartment portions provided to accommodate the lower portion of the the individual spark plugs, it is possible to effectively protect their spark gaps against accidental damage even when outer forces are applied during handling them roughly.

Because the threaded portions of the spark plugs are supportably engaged by the pluralistic tabs, it is possible to positively retain the tread portion of the spark plugs.

With the thread portion and the outer electrode accommodated by the lower cellular box, while the head portion of the insulator accommodated by the upper cellular box in such a manner that the insulator is at least partly exposed outside between the upper and lower cellular boxes, it is possible to visually confirm the presence or absence of all the spark plugs at the corresponding locations, and thus avoiding of disarranging the spark plugs so as to readily manage them after opening the casing package.

Due to the circular crease lines defined by the perforation, it is possible to readily bend the tabs so as to accommodate the thread portions into the accommodation holes with ease when forcing the outer electrode and the thread portion on the region within the circular crease line.

With the streaks of the perforations provided on the tray, it is possible to individually handle the spark plugs by separating the tray along the perforations. Even after the tray is separated, the spark plug is protected against inadvertent damage because the lower and upper cellular boxes accommodates the lower and upper ends of the spark plug respectively.

With the casing package made of the transparent material, it is possible to visually confirm the insulator outside of the casing package so as to distinguish the quantity and type (lot number) of the spark plugs.

With the mount board provided on the underside of the tray, it is possible to conveniently take the spark plugs out of the casing package, and replenish the needed number of the spark plugs by observation.

With the stopper lugs provided around the retainer holes of the array of the upper cellular boxes, it is possible to positively retain the head portions of the insulators securely against undesired removal when the head portions of the insulators are accommodated into the retainer holes.

BRIEF DESCRIPTION OF THE DRAWINGS

These and other objects, aspect and embodiments of the invention will be described in more detail with reference to the following drawing figures, of which.

DETAILED DESCRIPTION OF PREFERRED EMBODIMENTS OF THE INVENTION

Figure 1:
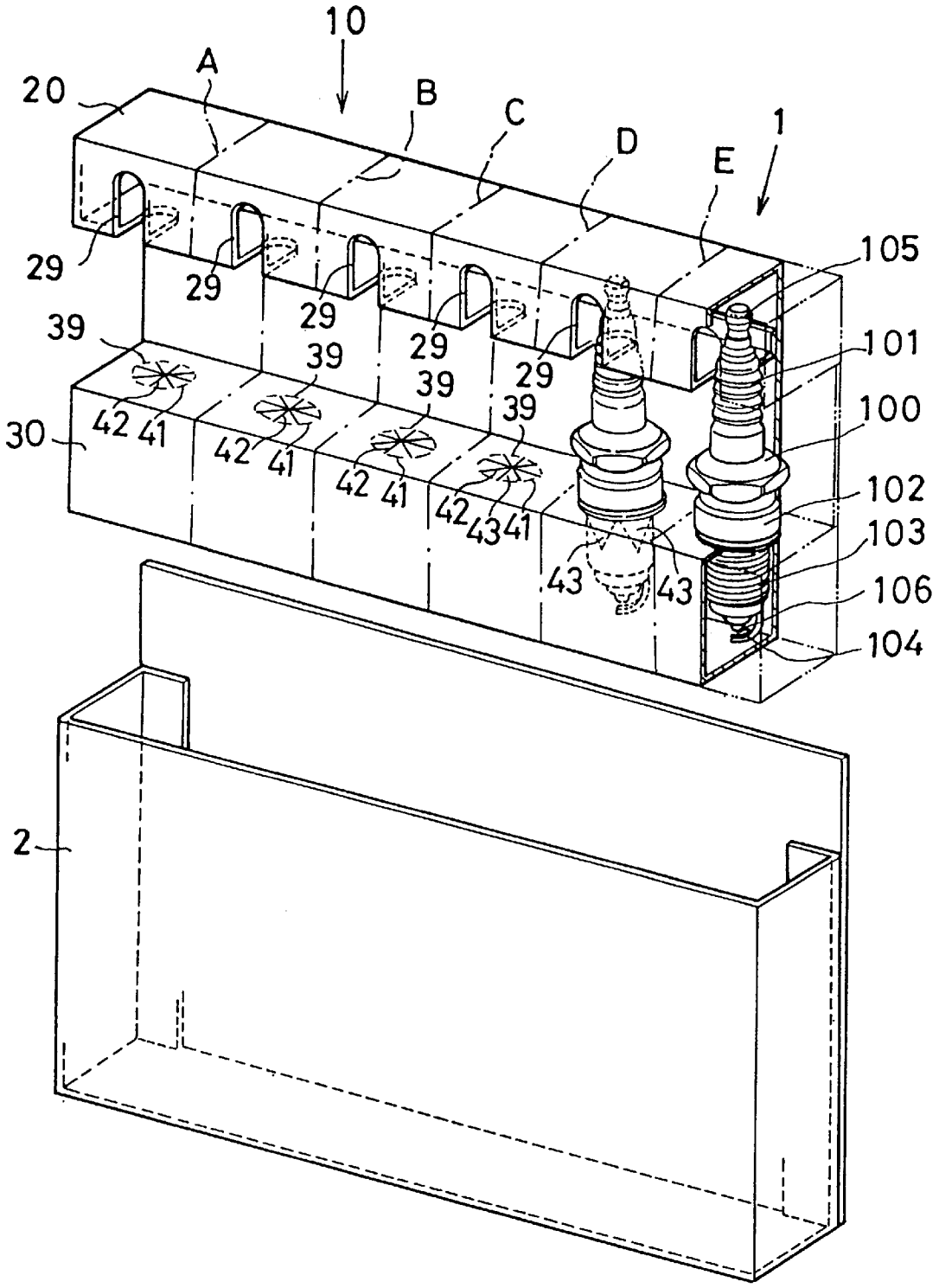
FIG. 1 is an exploded perspective view of a package box for a spark plug according to a first embodiment of the invention.

Referring to FIG. 1 which shows a package box 1 for a plurality (e.g., six) of spark plugs 100 according to a first embodiment of the invention. The package box 1 includes a paper tray 10 and a casing package 2 which accommodates the tray 10.

Figure 2:
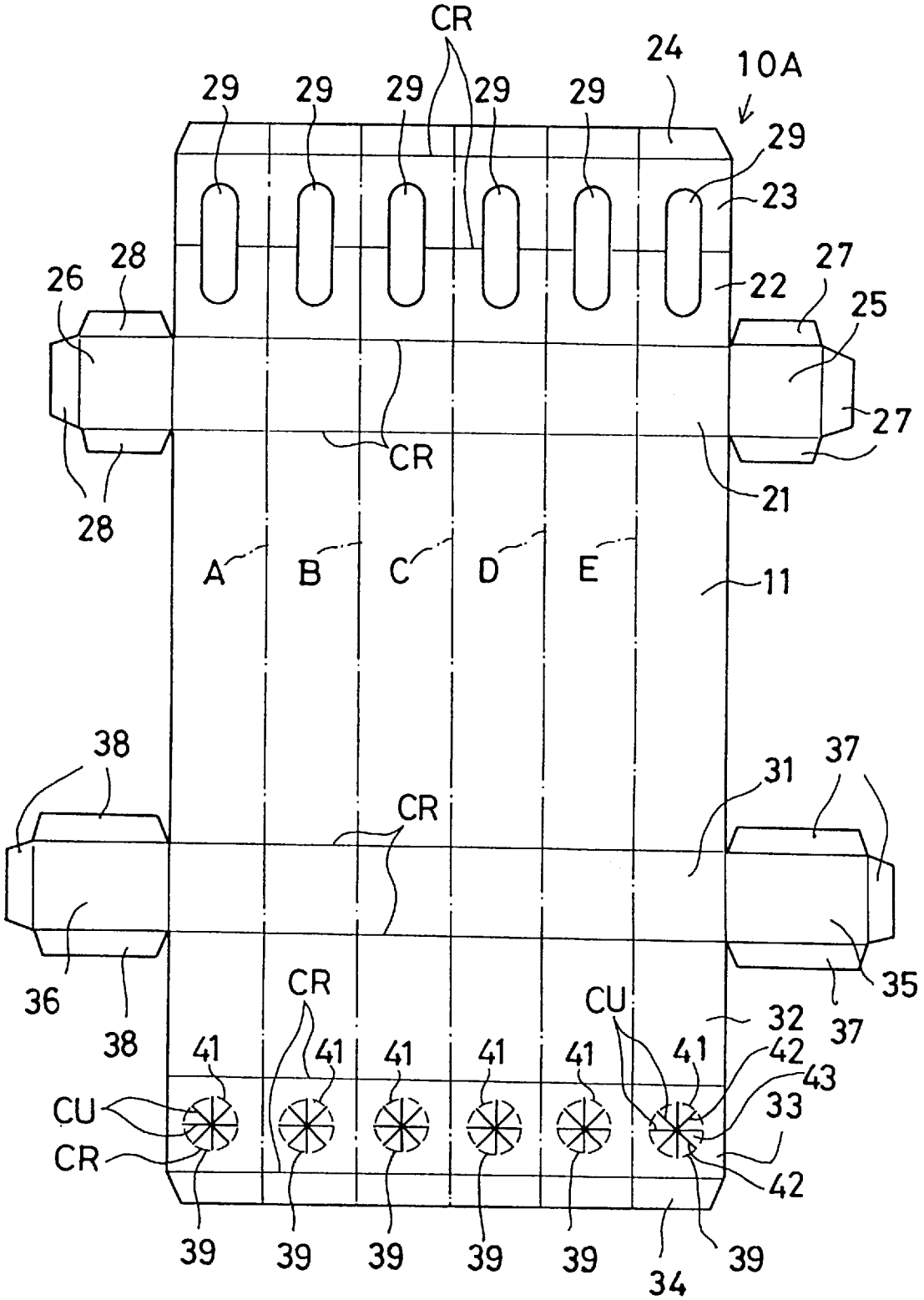
FIG. 2 is a development view of the package box for the spark plug.

The tray 10 is made of a sheet of thin corrugated cardboard or a pasteboard to have an upper cellular box 20 and a lower cellular box 30 which in turn serves as a retainer portion and a compartment portion. Before making the tray 10, a development is depicted on a cutting board 10A as shown In FIG. 2.

The cutting board 10A has a main divisional area 11 including a vertical dimension greater than a lengthwise dimension of the spark plug 100, while at the same time, including a lateral dimension greater than a total width of the six spark plugs combined. An upper part of the main divisional area 11 has sections 21, 22 and 23 for making the upper cellular box 20, while a lower part of the main divisional area 11 has sections 31, 32 and 33 for making the lower cellular box 30. Each of the sections 23, 33 has a margin to paste up as designated by numerals 24, 34.

With right and left ends of the section 21, there is provided a reinforcing section for strengthen the cellular box 20 as designated by numerals 25, 26. With right and left ends of the section 31, there is provided a reinforce section for physically strengthening the cellular box 30 as designated by numerals 35, 36. Around each of the reinforcing sections 25, 26, 35 and 36, there is provided a margin to paste up as designated by numerals 27, 28, 37 and 38.

On the sections 22, 23 for making the upper cellular box 20, there is provided an array of six elliptical holes 29 straddling a boundary between the sections 22, 23 to admit a head portion of the insulator 101 of the corresponding spark plug 100.

On the section 33 for making the lower cellular box 30, there is provided an array of six accommodation holes 39 to admit a thread portion 103 formed on a metallic shell 102 of the corresponding spark plugs 100.

In order to open the accommodation holes 39, circular crease lines 41 are beforehand provided in correspondence to the accommodation holes 39 so that the thread portions 103 are to be inserted. The circular crease lines 41 might change to polygon once the thread portions 103 are inserted to the accommodation holes 39 as described hereinafter. From the central portion toward each of the circular crease lines 41, a plurality of incision lines 42 are provided to orient in a radial direction. When the outer electrode 104 and the thread portion 103 are in turn forced on a section surrounded by the circular crease line 41, the incision lines 42 are expanded to form pluralistic tabs 43 which are bent downward along the crease lines 41. Then, the thread portion 103 is accommodated into accommodation holes 39 with the thread portion 103 supportably engaged by the tabs 43. It is preferably that the number of the incision lines 42 may be 3~10 in order to force the thread portion 103 against the section surrounded by the circular crease line 41.

It is observed that the reinforcing sections 25, 26, 35 and 36 may be consecutively extended from the main divisional area 11 or other sections 22, 23, 32 and 33 instead of extending them from the sections 21, 31. The paste-up margins 27, 28, 37 and 38 may be provided at another area than the reinforcing sections 25, 26, 35 and 36. The number of the paste-up margins may be altered as desired.

Upon making the tray 10 as shown in FIG. 1, the cutting board 10A is folded along crease lines (shown by CR in FIG. 2) with the margins 27, 28, 37 and 38 pasted up.

After folding the cutting board 10A into the tray 10, the tray 10 is folded to have the lower cellular box 30 to accommodate the thread portion 103 and the outer electrode 104 of the metallic shell 102, and at the same time, having the lower cellular box 20 to accommodate a terminal electrode 105 and an upper portion of the insulator 101 which serves as the head portion of the insulator 101 including the terminal electrode 105. As shown by dot-dash lines A~E in FIG. 2, five streaks of perforations are provided on the cutting board 10A to discretely separate any of the spark plugs as desired.

The casing package 2 is made dimensionally greater than the tray 10 so as to tightly accommodate the tray 10. When the tray 10 is accommodated into the upper open type casing package 2, an entire strength becomes sufficient to hold the spark plugs in it by the double layer of tray 10 and the casing package 2. It is to be observed that the casing package 2 may be defined by a side open type instead of the upper open type.

Figure 3A:
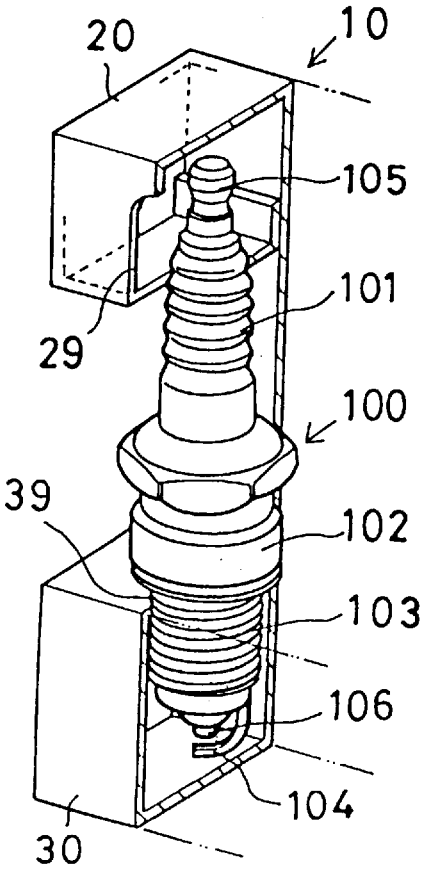
FIGS. 3*a* and 3*b* are partial perspective view of the tray shown to explain how the spark plug is accommodated and taken out.

Upon packing or crating the spark plugs 100 into the package box 1 in which the tray 10 is accommodated into the casing package 2, the thread portion 103 of the metallic shell 102 is firstly forced against the section within the circular crease lines 41 to expand the incision lines 42 so as to open the accommodation hole 39 on the lower cellular box 30. Then, the thread portion 103 is accommodated into the accommodation hole 39 with the thread portion 103 supportably engaed by the tabs 43. Thereafter, the upper portion of insulator 101 is admitted into the retainer hole 29 of the upper cellular box 20 as shown in FIG. 3*a*. After accommodating the six spark plugs into the tray 10, the tray 10 is encased into the casing package 2 so as to complete the packing operation.

As a result, the thread portion 103 is sufficiently protected by the tabs 43, and the outer electrode 104 is protected by the lower cellular box 30 so that no influence is given on the spark gap between the center and outer electrodes 106, 104. The spark plugs 100 are doubly protected by the tray 10 and the casing package 2 which accommodates the tray 10, the package box 1 positively protects the spark plugs 100 against the damage caused by the exterior force while roughly handling the package box 1.

Figure 3B:
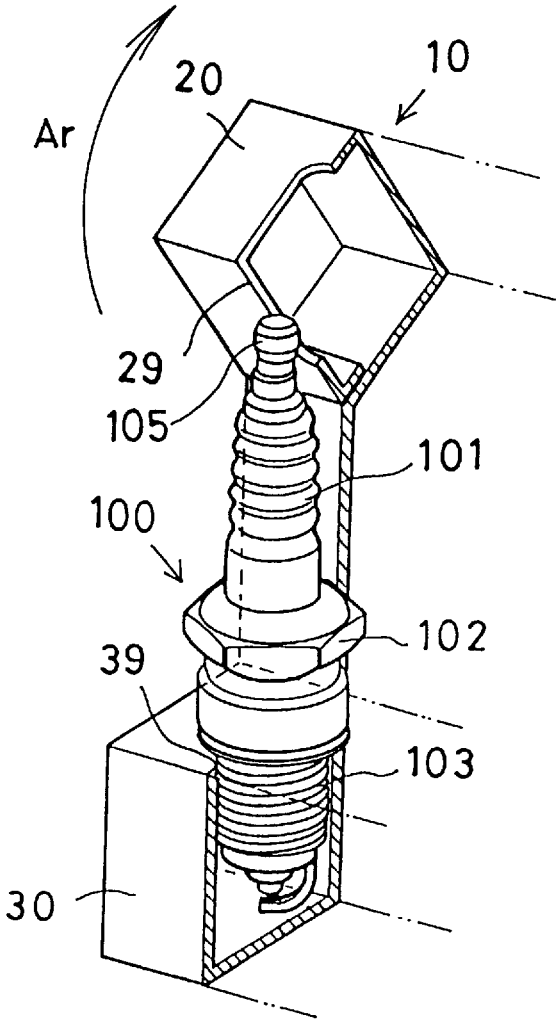

When taking out any of the spark plugs 100, the cellular box 20 is turned along a direction of arrow (Ar) to expose the terminal electrode 105 with the tray 10 withdrawn from the casing package 2 as shown in FIG. 3*b*. Then, the desired spark plug is taken out by grabbing the metallic shell 102 of any of the spark plugs 100.

As apparent from the foregoing description, the spark plugs are readily packaged in the package box 1, while easily taken out when in use. Once the spark plugs are packaged, the outer electrode 104 is accommodated by the lower cellular box 30, and at the same time, the package box 1 is physically strengthened by the double structure of the tray 10 and the casing package 2, thus protecting the spark gap against mechanically adverse influence since the package box 1 is unlikely to be easily squelched. Since it is possible to visually confirm the presence or absence of any of the spark plugs only by pulling out the tray 10 from the package box 1, the number of the spark plugs left on the tray 10 is readily confirmed.

Figure 4:
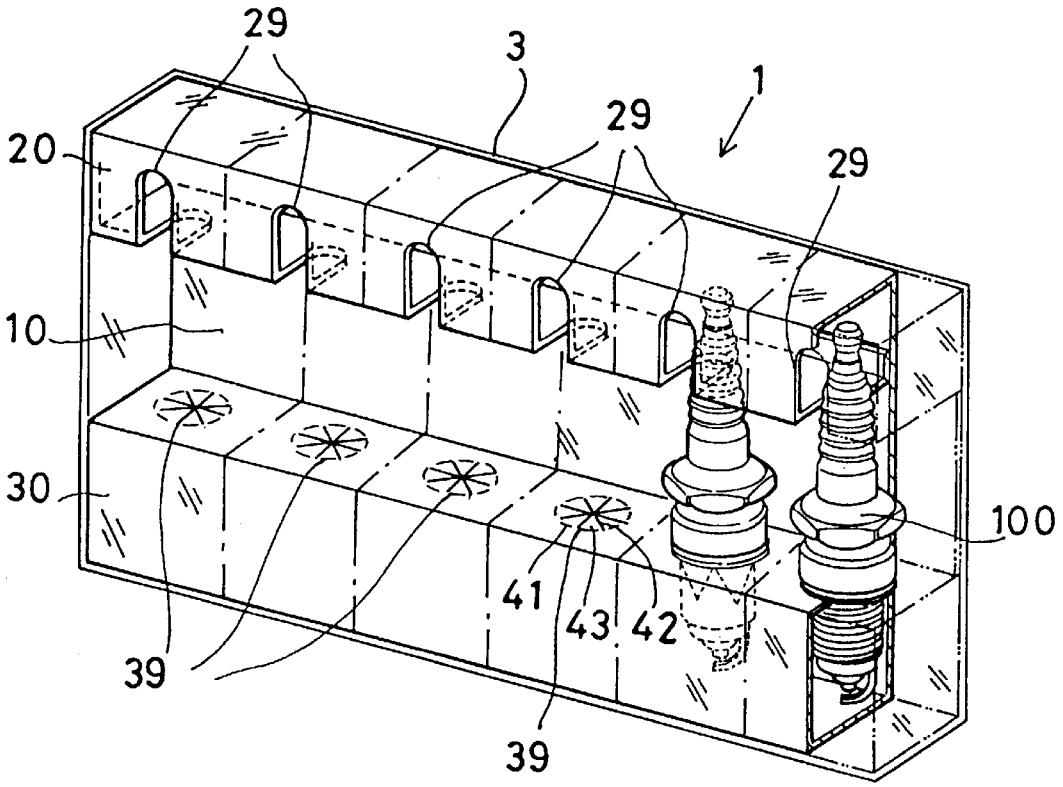
FIG. 4 is a perspective view of a package box for a spark plug according to a second embodiment of the invention.

FIG. 4 shows a second embodiment of the invention in which a transparent wrapper 3 is used to pack the tray 10 instead of the casing package 2. In this instance, the spark plugs 100 are visually confirmed from outside through the transparent wrapper 3 which is made from a thin sheet of plastic material. This makes it possible to further confirm the type of the spark plugs 100 accommodated by the package box 1.

Figure 5:
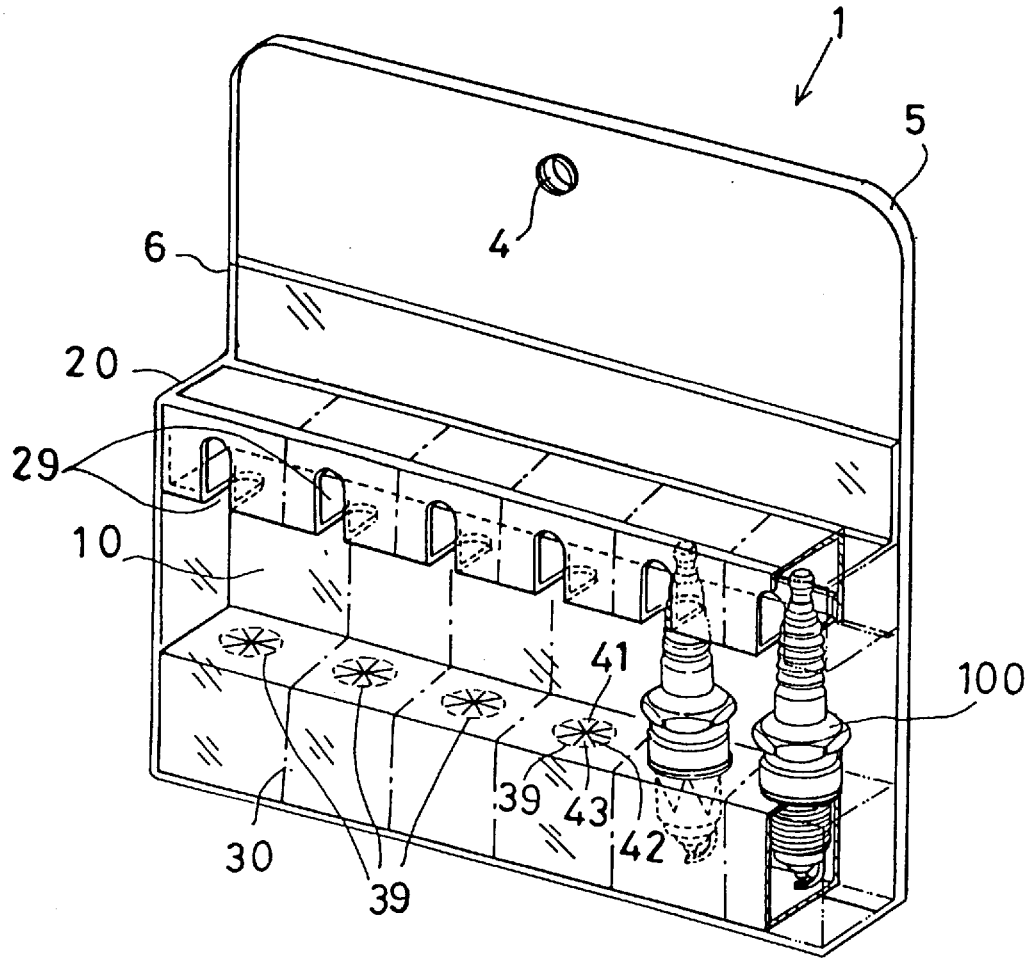
FIG. 5 is a perspective view of a package box for a spark plug according to a third embodiment of the invention.

FIG. 5 shows a third embodiment of the invention in which a mount board 5, which has a hanging hole 4 is fixedly provided on the underside of the tray 10. The tray 10 is encircled by a transparent wrapper 6 which substantially holds a J-shaped configuration. In this instance, any of the spark plugs 100 are readily taken out from the tray 10 in use and the rest of the spark plugs are kept by hanging the tray 10 on an appropriate wall even after the transparent wrapper 6 is removed from the tray 10.

With the stopper lugs 51 (see FIG. 9 discussed in detail below) provided on the periphery of the retainer holes 29 of the upper cellular boxes 20, it is possible to firmly hold the head portion of the insulator 101 in place.

Figure 6:
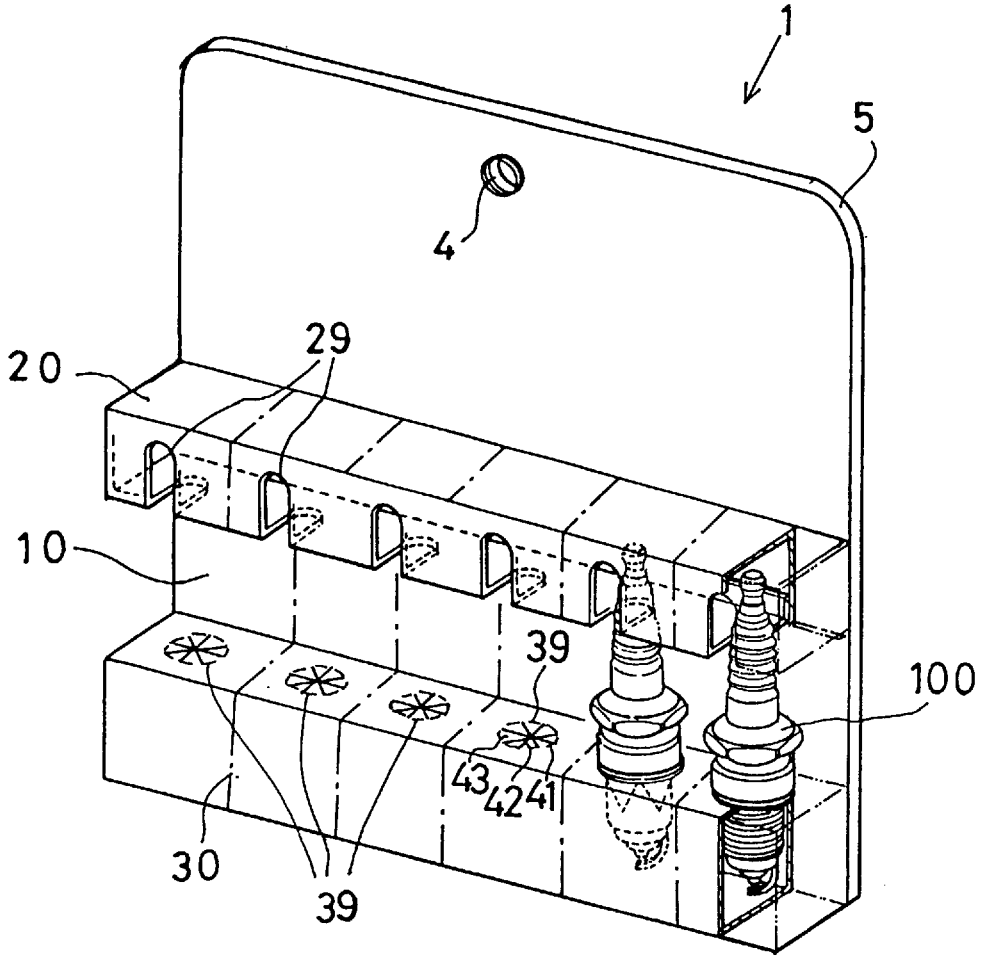
FIG. 6 is a perspective view of a package box for a spark plug according to a fourth embodiment of the invention.

FIG. 6 shows a fourth embodiment of the invention in which the mount board 5, which has the hanging hole 4 is adhered to the underside of the tray 10. By grabbing the mount board 5, it is possible to readily take out the spark plugs from the tray 10, and replenish the needed number of spark plugs by observation.

Figure 7:
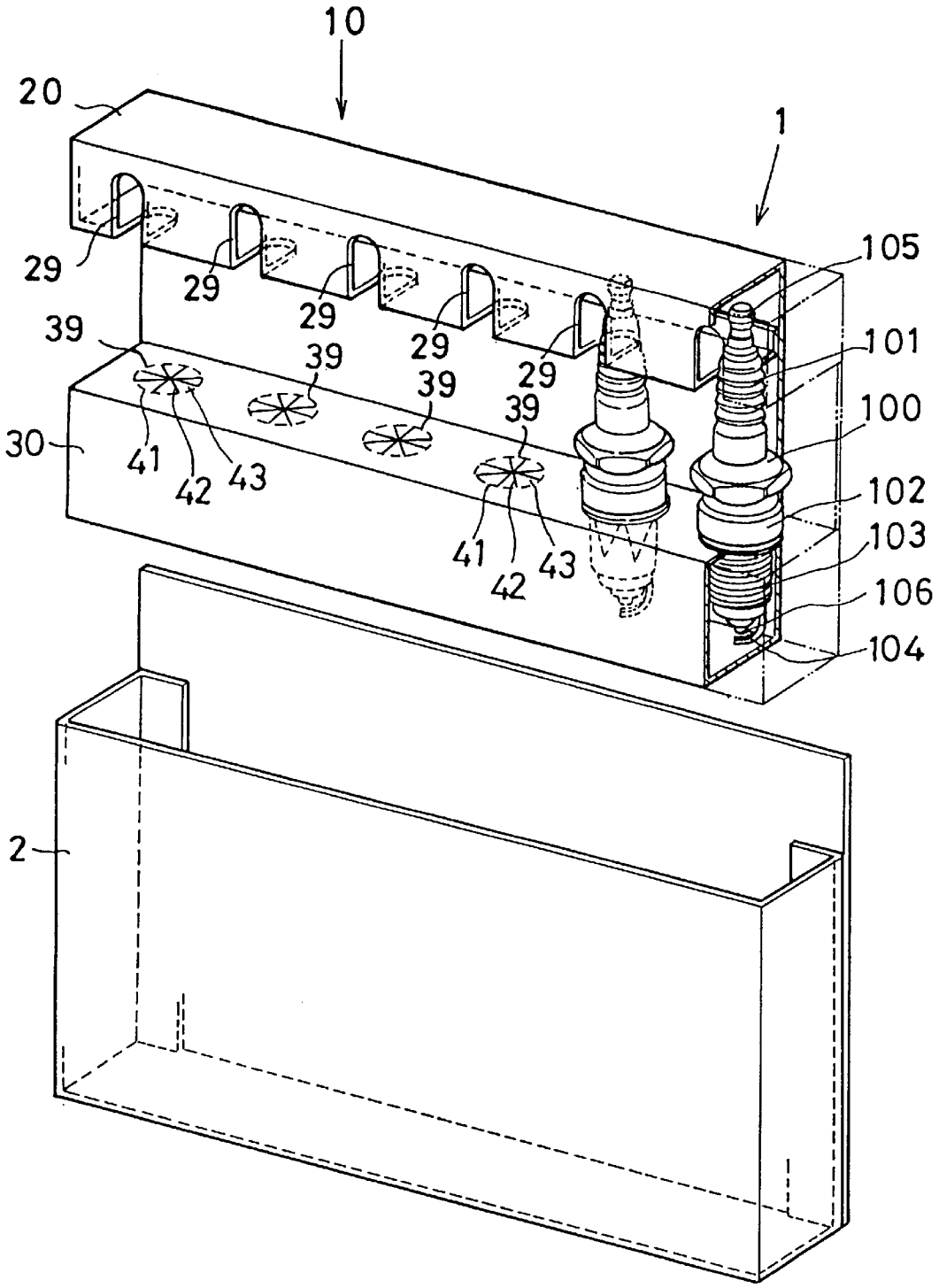
FIG. 7 is a perspective view of a package box for a spark plug according to a fifth embodiment of the invention.
Figure 8:
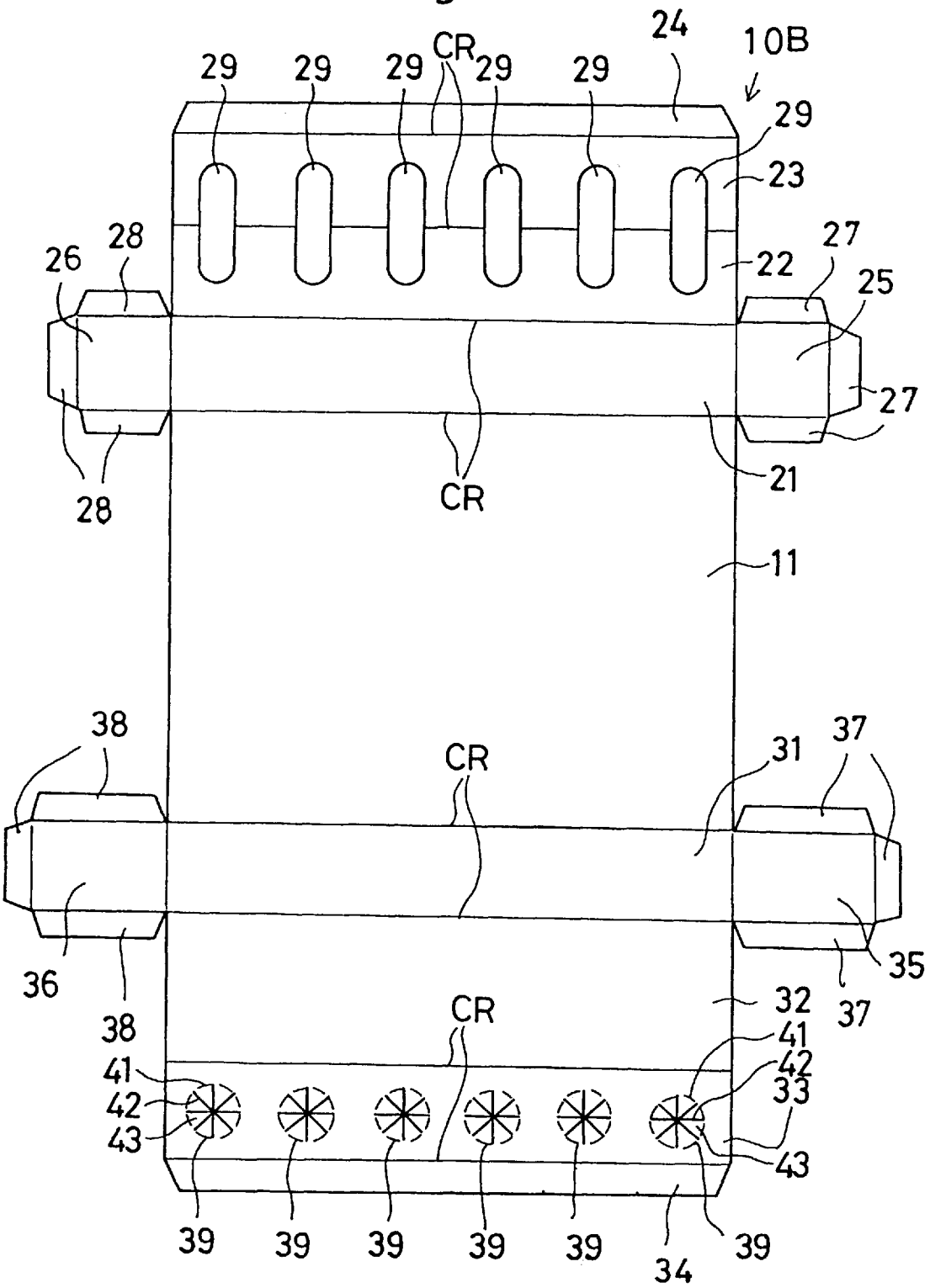
FIG. 8 is an exploded view of a tray according to the fifth embodiment of the invention.

FIGS. 7 and 8 show a fifth embodiment of the invention in which the perforations A~E of FIGS. 1 and 2 are omitted. On the cutting board 10B, the circular crease lines 41 and the excisable lines 42 are provided at the regular intervals to form the accommodation holes 39 of the lower cellular boxes 30 so as to accommodate the thread portions 103 and the outer electrodes 104 of the spark plugs 100 in the same manner as described in the first embodiment of the invention. The U-shaped retainer holes 29 are also provided with the upper cellular boxes 30 at the regular intervals to accommodate the terminal electrode 105 and the head portion of the insulator 101.

Due to the reason that the thread portions 103 of the spark plugs 100 are accommodated by the accommodation holes 39 with the thread portion 103 supportably surrounded by the pluralistic tabs 43, it is possible to positively stabilize the spark plugs 100 within the cellular boxes 20 and 30. It is also possible to take out the spark plugs 100 by grabbing the exposed portion of the metallic shell 102.

Figure 9:
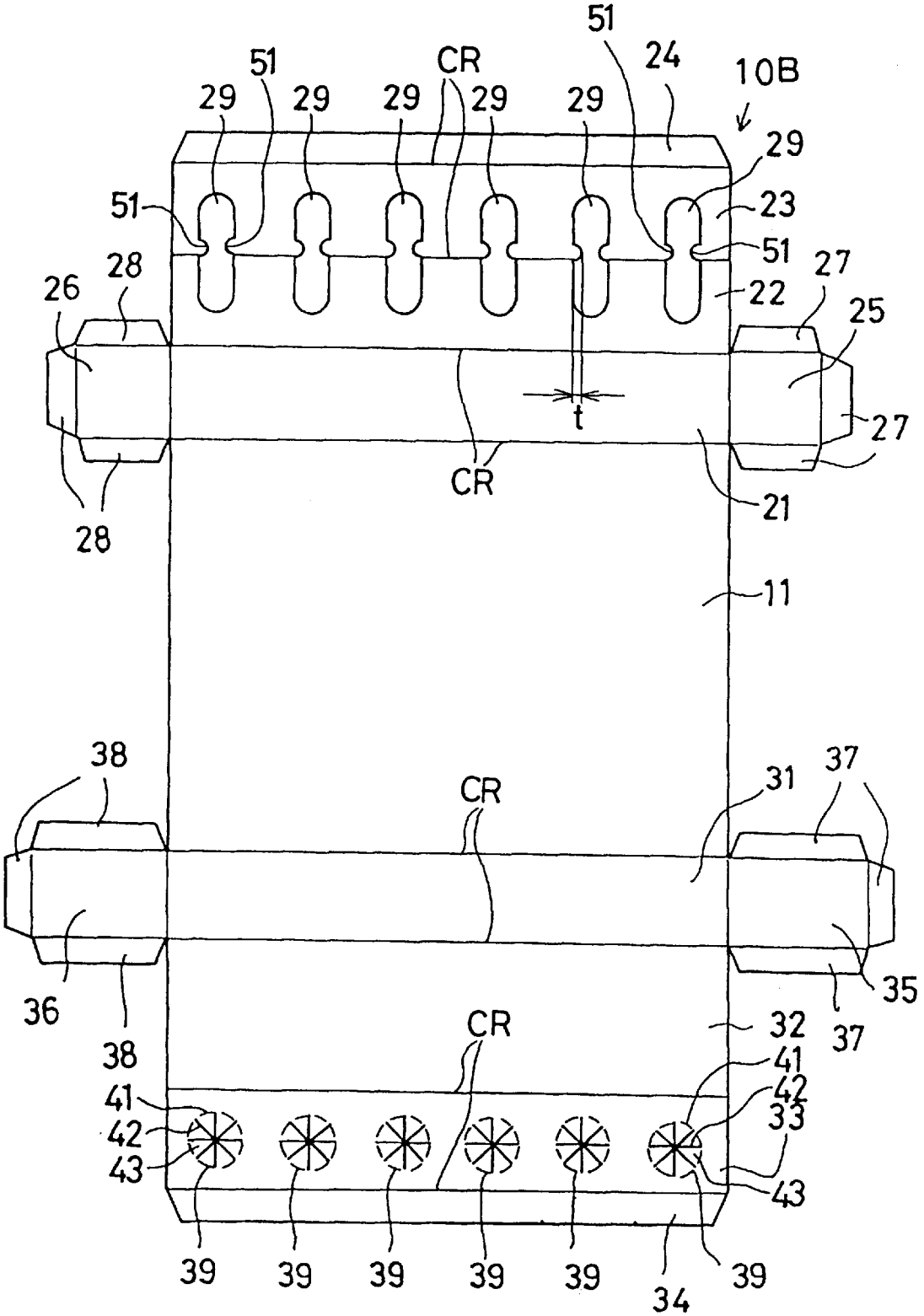
FIG. 9 is an exploded view of a tray according to a sixth embodiment of the invention.

FIG. 9 shows a sixth embodiment of the invention in which a single stopper lug or a pair of opposed stopper lugs 51 is provided on a periphery of the retainer holes 29 of the section 23 to retain the head portion of the insulator 101 of the spark plugs when making the package box 1 from the cutting board 10A of FIG. 8. The diametrically opposed stopper lugs 51 extend laterally by a predetemined length (t) across a somewhat upper part with respect to a middle of the retainer holes 29 toward the central area of the retainer holes 29. The stopper lugs 51 are such that they protect the head portion of the insulator 101 securely against the removal so as to positively retain it when the head portion of the insulator 101 is accommodated into the retainer hole 29.

It is to be observed that the stopper lugs 51 are applied to the tray 10 of the first through fifth embodiments of the invention in order to positively retain the spark plugs themselves with the help of the pluralistic tabs 43 defined around the accommodation holes 39 of the lower cellular box 30.

Figure 10:
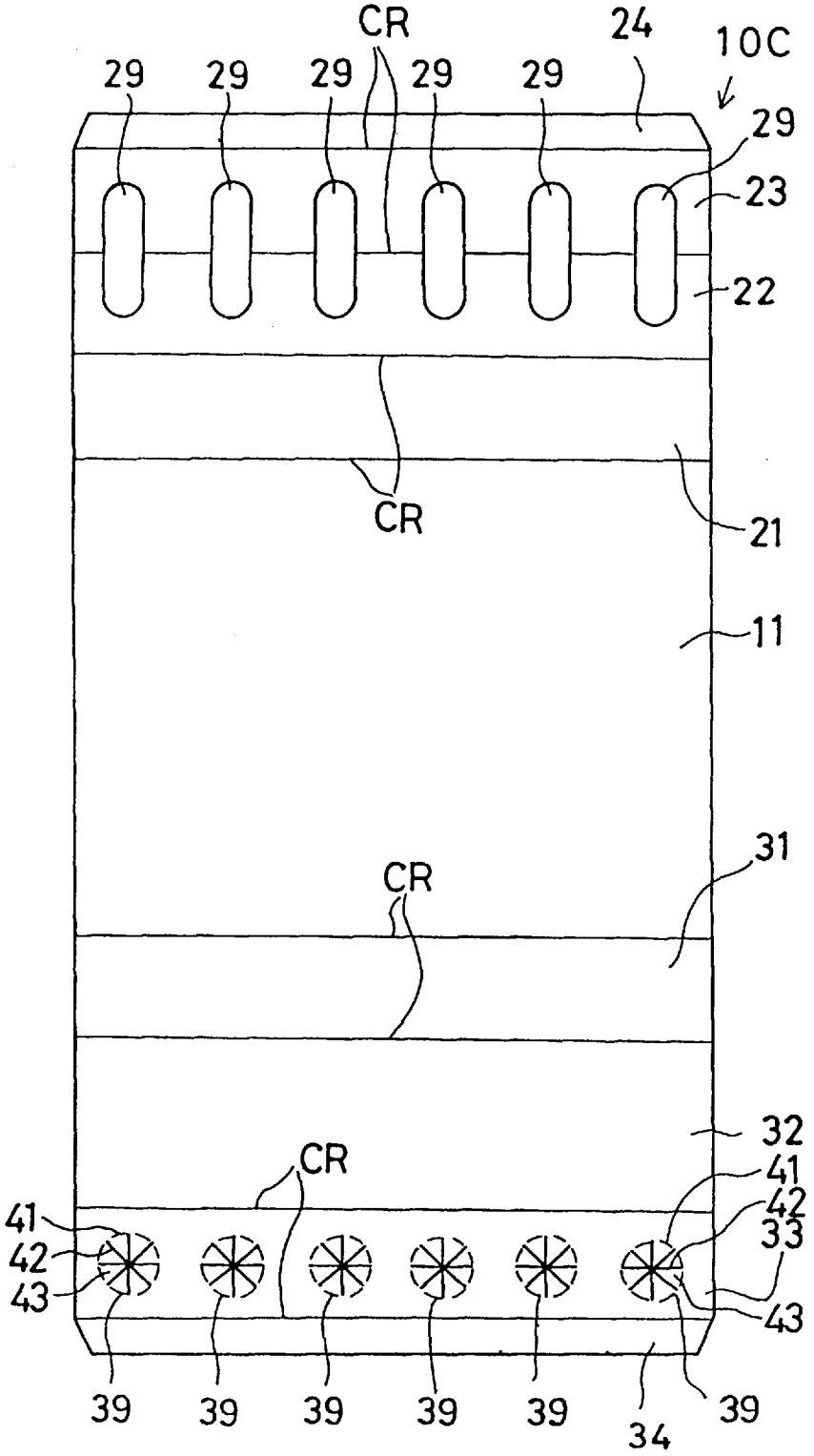
FIG. 10 is an exploded view of a tray according to a seventh embodiment of the invention.
Figure 11A:
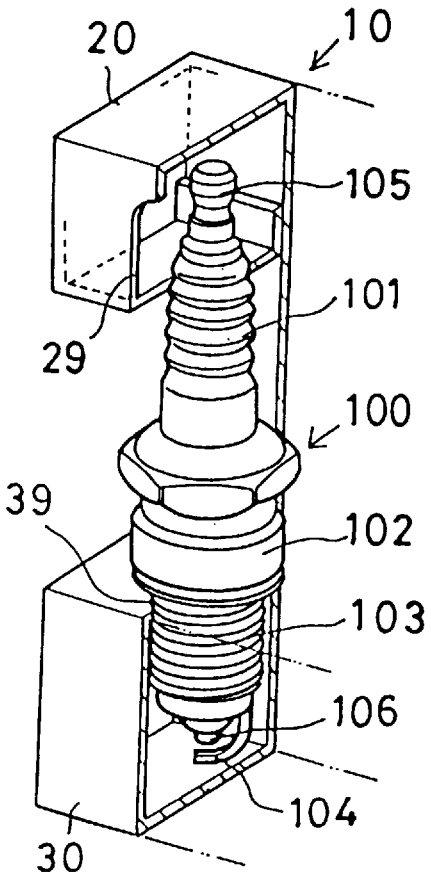
FIGS. 11*a* and 11*b* are views depicted to show when spark plugs are encased and taken out of a package box respectively.
Figure 11B:
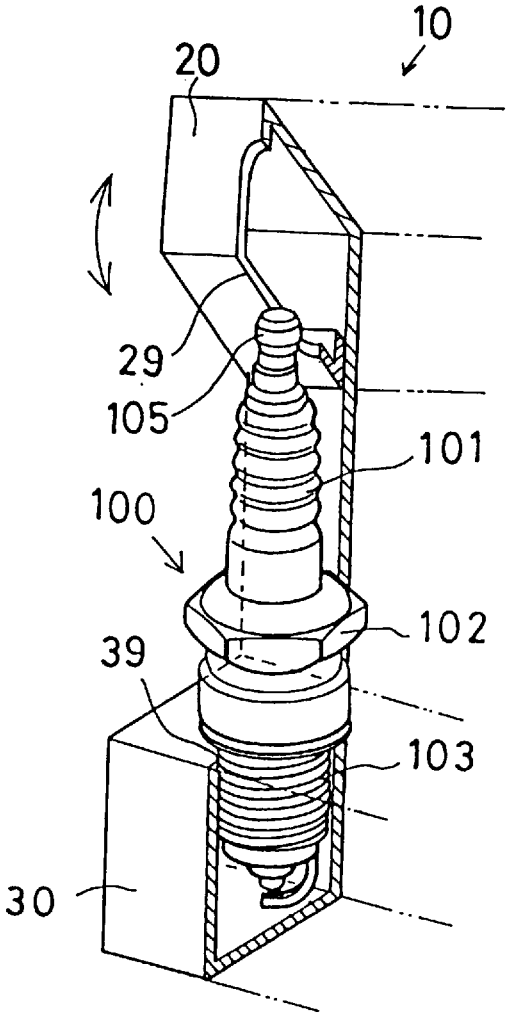
Figure 12:
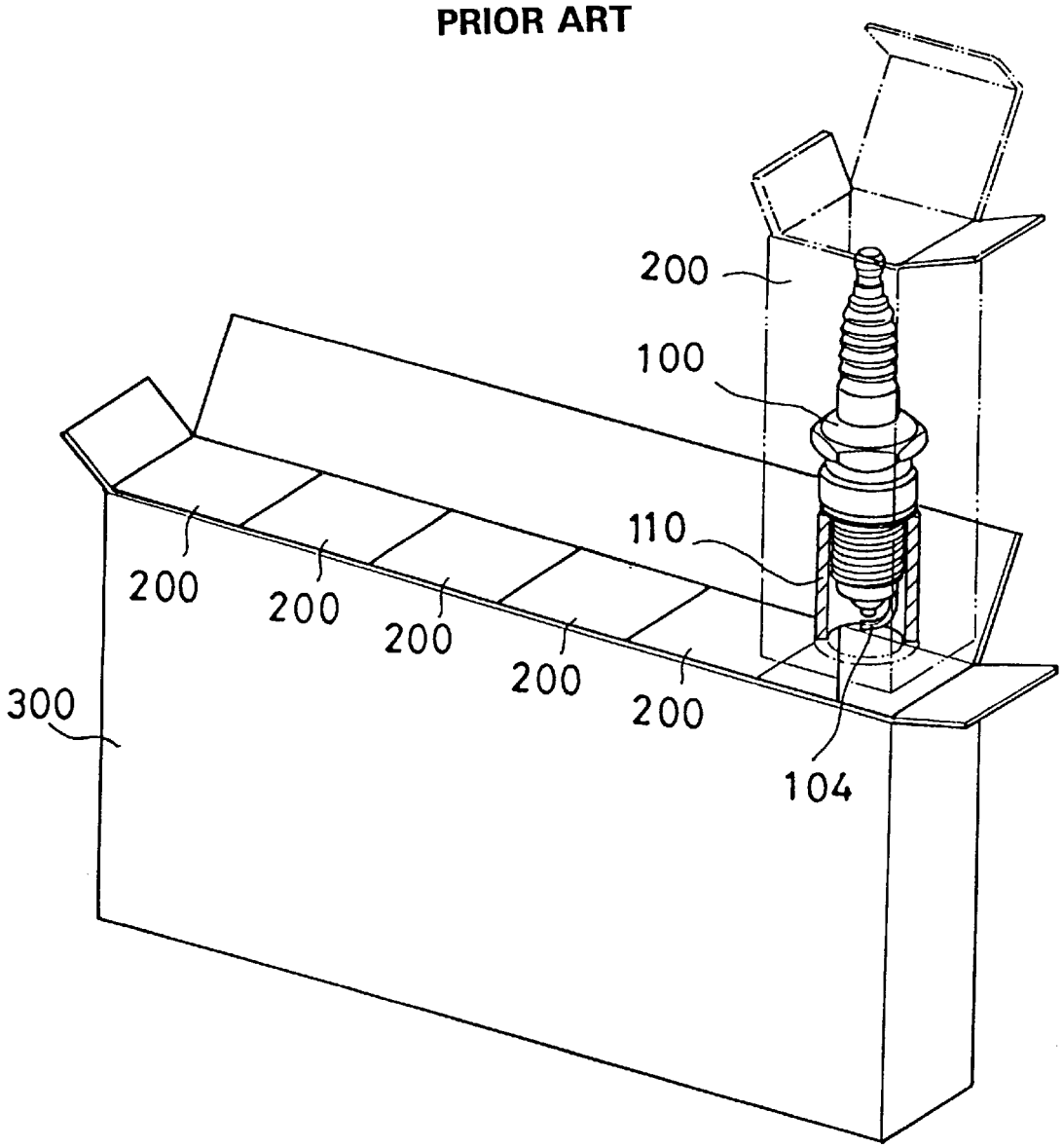
Fig.12 PRIOR ART
FIG. 12 is a perspective view of a prior art package box for a spark plug.

FIGS. 10, 11*a* and 11*b* show a seventh embodiment of the invention in which the reinforcing sections 25, 26, 35 and 36 of FIG. 8 are omitted from the tray 10B. As shown in FIG. 10, the reinforce sections 25, 26 of the upper cellular boxes 20 are left out, and the reinforcing sections 35, 36 of the lower cellular box 30 are left out from the cutting board 10C.

Upon encasing the spark plug 100, the thread portion 103 of the metallic shell 102 of the spark plug 100 is accommodated by the accommodation hole 39 via the pluralistic tabs 43 as shown in FIG. 11*b*. Then, the head portion of the insulator 101 is admitted by the retainer hole 29 as shown in FIG. 11*a*.

In this instance, since the upper cellular box 20 devoid of the reinforcing sections 25, 26 is in an upper open position with its cross section as a lozenge-shaped configuration, the upper cellular box 20 is turned downward (closed) to admit an entry of the head portion of the insulator 101 Into the retainer hole 29. The tray 10 is finally accommodated into the casing package 2 to complete the package of the spark plugs 100.

Upon taking out the spark plugs 100, after drawing out the tray 10 from the casing package 2, the upper cellular box 20 is turned upward to expose the head portion of the insulator 101 outside as shown in FIG. 11*b*.

It is to be observed that the tray structure of the seventh embodiment of the invention may be incorporated into the tray 10 of FIGS. 2 and 9 in order to readily turn the upper cellular box 20 downward and upward respectively.

As apparent from the embodiments of the invention thus far described, the tray is made from a piece of paper so that the tray 10 is readily put into automatic assembling. The thread portion 103 and the outer electrode 104 are accommodated by the lower cellular box 30 via the tabs 43. This makes it possible to positively retain them so as to effectively protect the spark gap against accidental damage due to the exterior force. Upon taking out any of the spark plugs by opening the upper cellular box 20, the spark plugs are readily grabbed since the spark plugs are visually confirmed. In the package in which the perforations A~E are provided on the tray 10, it is possible to handle the spark plugs individually by separating the tray 10 along the perforations A~E.

While the invention has been described with reference to the specific embodiments, it is understood that this description is not to be construed in a limiting sense in as much as various modifications and additions to the specific embodiments may be made by skilled artisans without departing the scope of the invention.

We claim:

1. A package box for a plurality of spark plugs, comprising:

a paper tray including an array of lower cellular boxes provided to accommodate lower portions of spark plugs to protect their spark gaps, and an array of upper cellular boxes provided to retain upper portions of said spark plugs in place;

a casing package provided to accommodate said paper tray;

said lower cellular boxes having circular crease lines each about the size so that individual thread portions of said spark plugs are to be inserted, and having a plurality of incision lines provided to be oriented radially toward central portions of said circular crease lines, so as to form a plurality of tabs which meet at a corresponding one of the central portions;

accommodation holes being formed with the plurality of tabs by expanding said incision lines and bending along said circular crease lines so as to accommodate thread portions of metallic shells of said sparks plugs, with said thread portions supportably engaged by said tabs when forcing outer electrodes and the thread portions of said spark plugs against regions surrounded by said circular crease lines; and said upper cellular boxes having upper open ended U-shaped retainer holes to admit head portions of insulators of said spark plugs so that said tray accommodates said spark plugs with said head portions of said insulators exposed between said array of the upper cellular boxes and said array of the lower cellular boxes.

2. In a package box for a plurality of spark plugs as recited in claim 1, wherein said circular crease lines of said accommodation holes are defined by circular perforations.

3. In a package box for a plurality of spark plugs as recited in claim 1, wherein streaks of perforations are provided on the tray so as to be separable between the neighboring upper and lower cellular boxes.

4. In a package box for a plurality of spark plugs as recited in claim 1, wherein said casing package is made of a transparent material directly encircling around the tray.

5. In a package box for a plurality of spark plugs as recited in claim 1, further comprising a mount board, which has a hanging hole, formed on an underside of said casing package.

6. In a package box for a plurality of spark plugs as recited in claim 1, further comprising a mount board, which has a hanging hole, formed on an underside of said tray.

7. In a package box for a plurality of spark plugs recited in claim 1, further comprising stopper lugs disposed on a periphery of said retainer holes to protect said head portions of said insulators securely against the removal from said retainer holes which are formed in said array of the upper cellular boxes of said tray.

8. A package box for a plurality of spark plugs, comprising:

a paper tray including an array of lower cellular boxes provided to accommodate lower portions of spark plugs to protect their spark gaps, and an array of upper cellular boxes provided to retain upper portions of said spark plugs in place;

a casing package provided to accommodate said paper tray;

said lower cellular boxes having circular crease lines each about the size so that individual thread portions of said spark plugs are to be inserted, and having a plurality of incision lines provided to be oriented radially toward central portions of said circular crease lines, so as to form a plurality of tabs;

accommodation holes being formed with the plurality of tabs by expanding said incision lines and bending along said circular crease lines so as to accommodate thread portions of metallic shells of said sparks plugs, with said thread portions supportably engaged by said tabs when forcing outer electrodes and the thread portions of said spark plugs against regions surrounded by said circular crease lines;

said upper cellular boxes having upper open ended U-shaped retainer holes to admit head portions of insulators of said spark plugs so that said tray accommodates said spark plugs with said head portions of said insulators exposed between said array of the upper cellular boxes and said array of the lower cellular boxes; and stopper lugs disposed on a periphery of said retainer holes to protect said head portions of said insulators securely against the removal from said retainer holes which are formed in said array of the upper cellular boxes of said tray.

* * * * *